US009027200B2

(12) United States Patent
Chong et al.

(10) Patent No.: US 9,027,200 B2
(45) Date of Patent: May 12, 2015

(54) UPRIGHT VACUUM CLEANER

(75) Inventors: Chung-Ook Chong, Gyeongsangnam-do (KR); Kyu-Chun Choi, Gyeongsangnam-do (KR); Geun-Bae Hwang, Gyeongsangnam-do (KR); Chang-Hwa Sun, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 323 days.

(21) Appl. No.: 13/500,047

(22) PCT Filed: Feb. 9, 2010

(86) PCT No.: PCT/KR2010/000786

§ 371 (c)(1),
(2), (4) Date: Apr. 3, 2012

(87) PCT Pub. No.: WO2011/099653

PCT Pub. Date: Aug. 18, 2011

(65) Prior Publication Data

US 2012/0198652 A1 Aug. 9, 2012

(51) Int. Cl.

| | |
|---|---|
| ***A47L 5/28*** | (2006.01) |
| ***A47L 9/02*** | (2006.01) |
| ***A47L 9/00*** | (2006.01) |

(52) U.S. Cl.

CPC .. *A47L 5/28* (2013.01); *A47L 9/009* (2013.01)

(58) Field of Classification Search

USPC ..... 15/354, 350, 351, 327.4, 411

See application file for complete search history.

(56) References Cited

U.S. PATENT DOCUMENTS

| | | | | |
|---|---|---|---|---|
| 7,607,196 | B2 * | 10/2009 | Li | 15/350 |
| 7,805,804 | B2 * | 10/2010 | Loebig | 15/351 |
| 7,950,102 | B2 * | 5/2011 | Lee et al. | 15/327.4 |
| 8,667,643 | B2 * | 3/2014 | Simonelli et al. | 15/411 |
| 2009/0165242 | A1 | 7/2009 | Lee et al. | |
| 2012/0090105 | A1 * | 4/2012 | Henderson | 15/3 |

FOREIGN PATENT DOCUMENTS

| | | | |
|---|---|---|---|
| JP | 5-228088 | A | 9/1993 |
| JP | 6-46649 | U | 6/1994 |
| JP | 2009-520542 | A | 5/2009 |
| KR | 20-1993-0000310 | Y1 | 1/1993 |
| KR | 10-2009-0074582 | A | 7/2009 |

* cited by examiner

*Primary Examiner* — Dung Van Nguyen

(74) *Attorney, Agent, or Firm* — Birch, Stewart, Kolasch & Birch, LLP

(57) ABSTRACT

Provided is an upright vacuum cleaner. The upright vacuum cleaner includes a suction nozzle comprising a plurality of wheels, a main body relatively rotatable with respect to the suction nozzle, and a steering device steering the plurality of wheels to correspond to the movement of the main body.

13 Claims, 13 Drawing Sheets

UPRIGHT VACUUM CLEANER

TECHNICAL FIELD

Embodiments relate to an upright vacuum cleaner.

BACKGROUND ART

In general, a vacuum cleaner is a device that sucks air containing dusts using a suction force generated by a suction motor mounted in a cleaner main body to filter the dusts in a dust separation device.

The vacuum cleaner may be classified into a canister vacuum cleaner in which a suction nozzle for sucking dusts is detachably disposed on a main body and connected to the main body through a connection device and an upright vacuum cleaner in which a suction nozzle is rotatably connected to a main body.

In the upright type cleaner, when a handle disposed on the cleaner main body is pushed or pulled, the suction nozzle connected to the main body is moved together with the main body. Also, to change a moving direction of the upright vacuum cleaner, a user should grasp the handle to apply a rotation force to the cleaner in a desired direction. In this case, a user's wrist may be strained, and also lots of labor may be required to change the moving direction.

DISCLOSURE OF THE INVENTION

Technical Problem

Embodiments provide an upright vacuum cleaner which is easily changed in its moving direction.

Technical Solution

In one embodiment, an upright vacuum cleaner includes: a suction nozzle comprising a plurality of wheels; a main body relatively rotatable with respect to the suction nozzle; and a steering device steering the plurality of wheels to correspond to the movement of the main body.

Advantageous Effects

According to the embodiments, the force applied to the main body to change the rotation direction of the suction nozzle may be transmitted into the wheels by the steering devices. Thus, since each of the wheels is rotated in a desired direction by the steering device, the user may easily change the rotation direction of the suction nozzle even though the user applies a less force.

BEST MODE FOR CARRYING OUT THE INVENTION

Figure 1:
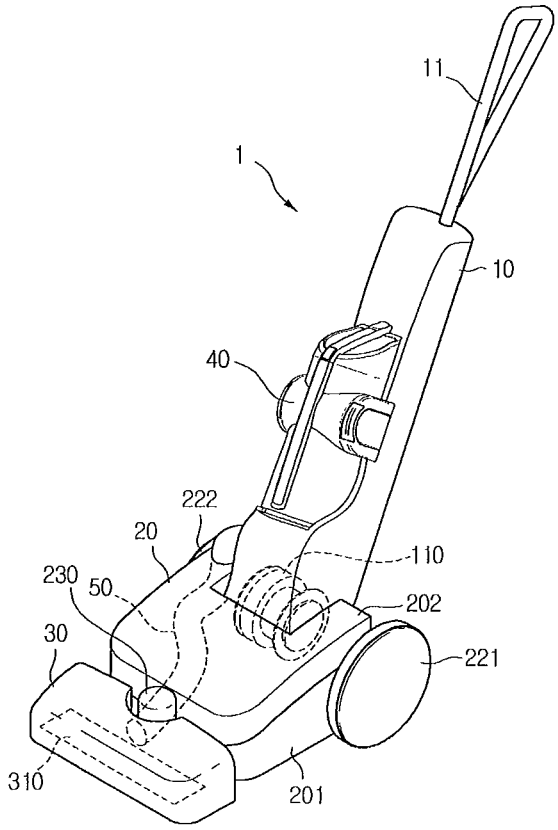
FIG. 1 is a perspective view of an upright vacuum cleaner according to a first embodiment.

Hereinafter, exemplary embodiments will be described with reference to the accompanying drawings. FIG. 1 is a perspective view of an upright vacuum cleaner according to a first embodiment.

Referring to FIG. 1, an upright vacuum cleaner 1 according to a first embodiment includes a cleaner main body 10 including a suction motor 110 for generating a suction force and suction nozzles 20 and 30 rotatably connected to the cleaner main body 10.

The suction nozzles 20 and 30 include a head 30 in which a suction hole 310 is defined and a connection device 20 rotatably connected to the head 30.

The connection device 20 connects the head 30 to the main body 10. The head 30 is horizontally rotatably connected to the connection device 20. The main body 10 is vertically rotatably connected to the connection device 20.

In detail, the main body 10 includes a dust separation device 40 for separating dusts from sucked air to store the separated dusts. A handle 11 to be grasped by a user is disposed on an upper portion of the main body 10.

A plurality of main wheels 221 and 222 are disposed on both sides of the connection device 20 to easily move the connection device 20. A rotation guide 230 for rotatably coupling the head 30 to the connection device 20 is disposed on a front side of the connection device 20.

The connection device 20 includes a lower body 201 and an upper body 202. For example, the rotation guide 230 may be disposed on the lower body 201.

A tube 50 for defining a passage through which the suction hole 310 communicates with the main body 10 is disposed within the head 30 and the connection device 20. The tube 50 extends from the suction hole to pass through the rotation guide 230, and then is connected to the main body 10.

Figure 2:
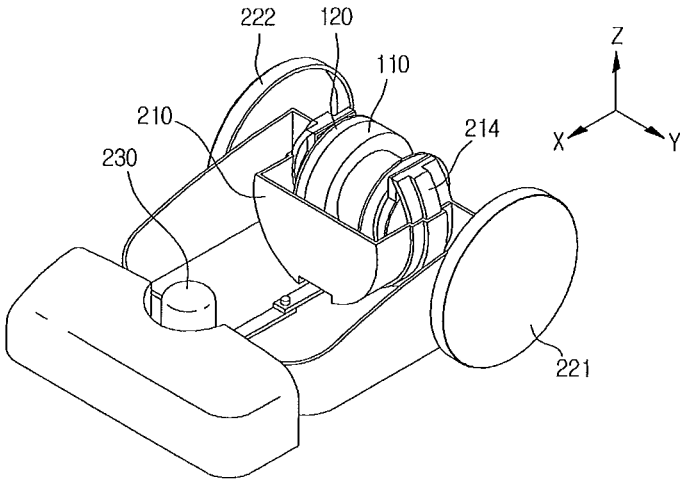
FIG. 2 is a perspective view illustrating an inner structure of a connection device according to the first embodiment.
Figure 3:
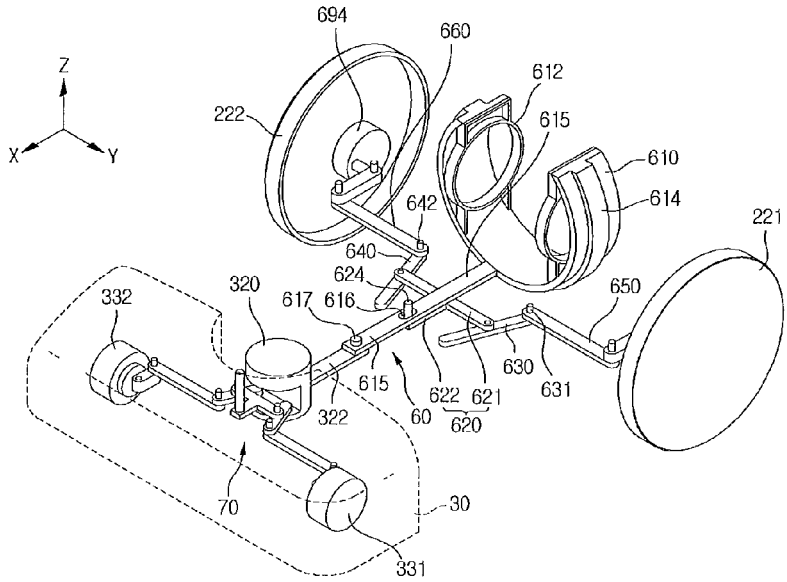
FIG. 3 is a perspective view illustrating a structure for transmitting a rotation force of a main body into a wheel of a suction nozzle.

FIG. 2 is a perspective view illustrating an inner structure of a connection device according to the first embodiment. FIG. 3 is a perspective view illustrating a structure for transmitting a rotation force of a main body into a wheel of a suction nozzle.

FIG. 2 illustrates a state in which a portion of the main body is seated.

Referring to FIGS. 1 to 3, the main body 10 includes a motor support part 120 for supporting the suction motor 110 at a position spaced from the suction motor 110. A main body receiving part 210 in which the main body 10 is received is disposed in the connection device 20.

As described above, the plurality of main wheels 221 and 222 are disposed on the connection device 20. The plurality of main wheels 221 and 222 include a left main wheel 221 and a right main wheel 222.

The head 30 includes a plurality of sub wheels 331 and 332 to easily move the head 30. The plurality of sub wheels 331 and 332 include a left sub wheel 331 and a right sub wheel 332.

In the current embodiment, the plurality of main wheels 221 and 222 are disposed on a rear side of the suction nozzle. Thus, the plurality of main wheels 221 and 222 may be referred to as right wheels. Also, the plurality of sub wheels 331 and 332 are disposed on a front side of the suction nozzle. Thus, the plurality of sub wheels 331 and 332 may be referred to as front wheels.

The plurality of sub wheels 331 and 332 may be disposed on a lower portion or a side surface of the head 30. For example, in FIG. 3, the plurality of sub wheels 331 and 332 are disposed on the lower portion of the head 30.

A guide coupling part 320 is disposed on the head 30 to couple the rotation guide 230 of the connection device 20. Thus, the head 30 and the connection device 20 may be relatively rotated with respect to each other by the rotation guide 230 and the guide coupling part 320.

Also, steering devices 60 and 70 are disposed on the suction nozzles 20 and 30 to easily change a moving direction of the suction nozzles 20 and 30, respectively.

In detail, the steering devices 60 and 70 include a first steering device 60 disposed on the connection device 20 and a second steering device 70 disposed on the head 30.

The first steering device 60 steers the plurality of main wheels 221 and 222 to transmit a rotation force of the main body 10 into the head 30. The second steering device 70 receives the rotation force of the main body 10 to steer the plurality of sub wheels 331 and 332. Hereinafter, the steering device will be described in detail.

Figure 4:
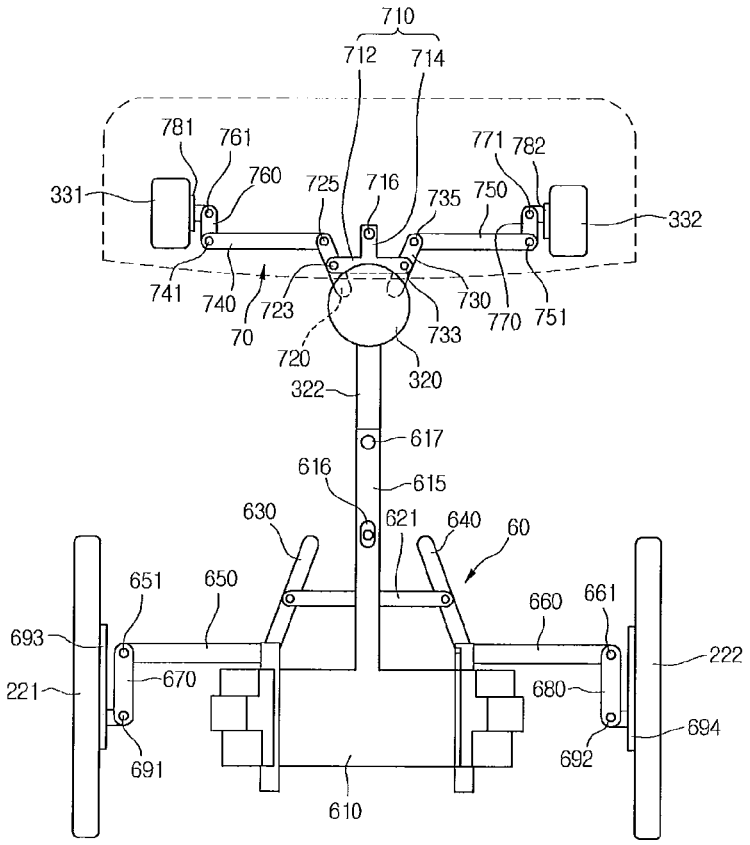
FIG. 4 is a plan view of the suction nozzle to illustrate a structure of a steering device according to the first embodiment.

FIG. 4 is a plan view of the suction nozzle to illustrate a structure of a steering device according to the first embodiment.

Referring to FIGS. 2 and 4, the first steering device 60 includes a first transmission part 610 for transmitting the rotation force of the main body 10. The first transmission part 610 includes a first rotation guide 612 supporting the motor support part 120 to guide the rotation of the motor support part 120. The motor support part 120 may be rotated with respect to a Y-axis by the first rotation guide 612 (see FIG. 3).

The main body receiving part 210 includes a second rotation guide 214 supporting the first transmission part 610 to guide the rotation of the first transmission part 610. Also, a guide part 614 interacting with the second rotation guide 214 is disposed on the first transmission part 610. The first transmission part 610 may be rotated with respect to an X-axis by the second rotation guide 214 (see FIG. 3).

An extension part 615 for transmitting a moving force of the main body 10 into the head 30 is disposed on the first transmission part 610. The extension part 615 extends from the first transmission part 610 toward the head 30.

A connector 332 connected the extension part 615 by a shaft 617 is disposed on the guide coupling part 320 of the head 30.

Also, the first steering device 60 includes a second transmission part for transmitting the rotation force of the first transmission part 610 into the main wheels 221 and 222.

The second transmission part includes a first link 620 connected to the extension part 615, a pair of second links 630 and 640 connected to the first link 620, a pair of third links 650 and 660 respectively connected to the second links 630 and 640, and a pair of fourth links 670 and 680 respectively connected to the third links 650 and 660 and connected to the main wheels 221 and 222.

The first link 620 includes a first body 621 disposed on the connection 20 in a left/right direction and a second body 622 extending from a central portion of the first body 621 toward the head 30. The second body 622 is connected to the extension part 615 by a shaft 624.

A shaft hole 616 passing through the shaft 624 is defined in the extension part 615. The shaft hole 616 is disposed in direction parallel to an extending direction of the extension part. The extension part 615 is rotated together with the first transmission part 610 when the main body 10 is rotated with respect to the X-axis. Thus, when the extension part 615 is rotated, the shaft hole 616 has a long hole shape to prevent the extension part 615 from interfering with the shaft 624.

The pair of second links 630 and 640 includes a second left link 630 and a second right link 640. The pair of second links 630 and 640 extends in a front/rear direction of the connection device 20. The first body 621 has one side rotatably connected to a central portion of the second left link 630. Also, the first body 621 has the other side rotatably connected to a central portion of the second right link 640.

The pair of third links 650 and 660 includes a third left rink 650 and a third right link 660. The pair of third links 650 and 660 extends in left/right direction of the connection part 20.

The second left link 630 has a rear end rotatably connected to one end of the third left link 650 by a shaft 631. The second right link 640 has a rear end rotatably connected to one end of the third right link 660 by a shaft 642.

The fourth links 670 and 680 includes a fourth left link 670 and a fourth right link 680. The third left link 650 has the other end rotatably connected to one end of the fourth left link 670 by a shaft 651. The third right link 660 has the other end rotatably connected to the fourth right link 680 by a shaft 661.

The fourth left link 670 has the other end coupled to a first wheel body 693 connected to the left main wheel 221. The first wheel body 693 is provided at a rotation center of the left main wheel 221.

The fourth right link 680 has the other end coupled to a second wheel body 694 connected to the right main wheel 222. The second wheel body 694 is provided at a rotation center of the right main wheel 222.

The pair of fourth links 670 and 680 transmits a force transmitted from the extension part 615 into the wheel bodies 693 and 694. Also, each of the main wheels 221 and 222 is rotated together with each of the fourth links 670 and 680 and each of the wheel bodies 693 and 694.

Also, the fourth left rink 670 is rotatably coupled to a left shaft 691 disposed on the connection device 20, and the fourth right link 680 is rotatably coupled to a right shaft 692 disposed on the connection device 20.

The second steering device 70 includes a first link 710 rotatably connected to a fixed shaft 716 disposed on the head 30, a pair of second links 720 and 730 connected to the first link 710, a pair of third links 740 and 750 respectively connected to the second links 720 and 730, and a pair of fourth links 760 and 770 respectively connected to the third links 740 and 750 and connected the sub wheels 331 and 332.

The first link 710 includes a first body 712 extending in a left/right direction of the head 30 and a second body 714 extending in a front direction of the head 30 at a central portion of the first body 712. The second body 714 is connected to the fixed shaft 716.

The pair of second links 720 and 730 includes a second left link 720 and a second right link 730. The first body 712 has one side rotatably connected to a central portion of the second left link 720 by a shaft 723. The second body 712 has the other side rotatably connected to a central portion of the second right link 730 by a shaft 733.

The pair of third links 740 and 750 includes a third left link 740 and a third right link 750. The third left link 740 has one side rotatably connected to the other end of the second left link 720 by a shaft 725. The third right link 750 has one side rotatably connected to the other end of the second right link 730 by a shaft 735.

The pair of second links 720 and 730 extends in a front/rear direction of the connection device 30. Also, the pair of third links 740 and 750 extends in a left/right direction of the head 30.

The pair of fourth links 760 and 770 includes a fourth left link 760 and a fourth right link 770. The third left link 740 has the other end rotatably connected to one end of the fourth left link 760 by a shaft 741. The third right link 750 has the other end rotatably connected to the fourth right link 770 by a shaft 751.

The fourth left link 760 has the other end coupled to a first wheel body 781 connected to the left sub wheel 331. The first wheel body 781 is provided at a rotation center of the left sub wheel 331.

The fourth right link 770 has the other end coupled to a second wheel body 782 connected to the right sub wheel 332. The second wheel body 782 is provided at a rotation center of the right sub wheel 332.

The pair of fourth links 760 and 770 transmits a force transmitted from the first link 710 into the wheel bodies 781 and 782. Also, each of the sub wheels 331 and 332 is rotated together with each of the fourth links 760 and 770 and each of the wheel bodies 781 and 782.

Also, the fourth left rink 760 is rotatably coupled to a left shaft 761 fixed to the head 30, and the fourth right link 770 is rotatably coupled to a right shaft 771 fixed to the head 30.

Hereinafter, an operation of the steering device will be described in detail.

Figure 5:
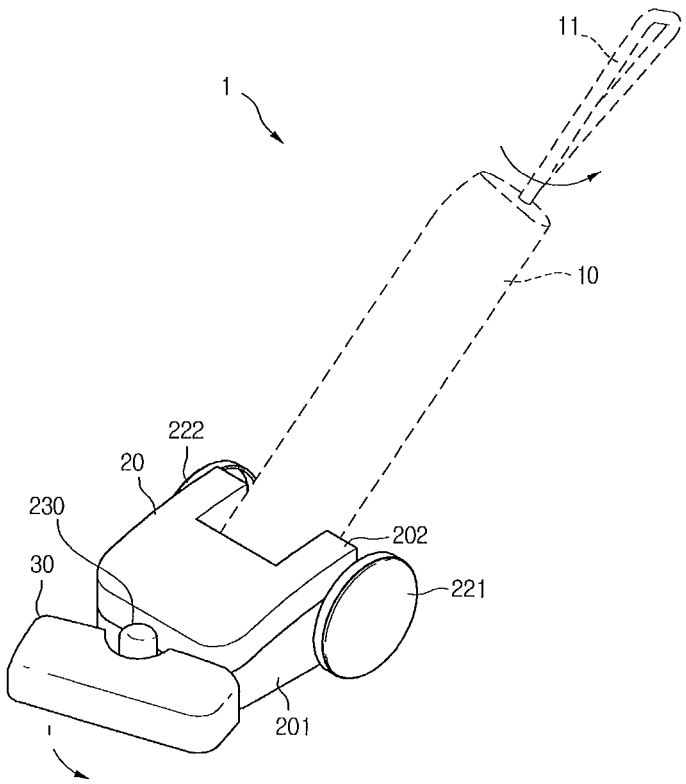
FIG. 5 is a perspective view of the upright vacuum cleaner in a state where the suction nozzle is rotated in a left direction.
Figure 6:
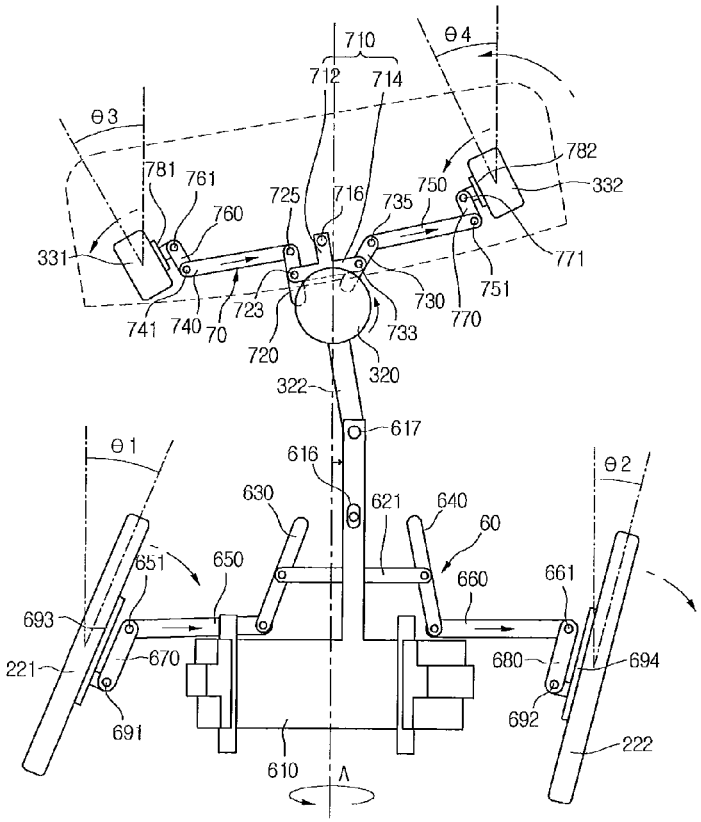
FIG. 6 is a view of the steering device when the suction nozzle is rotated in a left direction.
Figure 7:
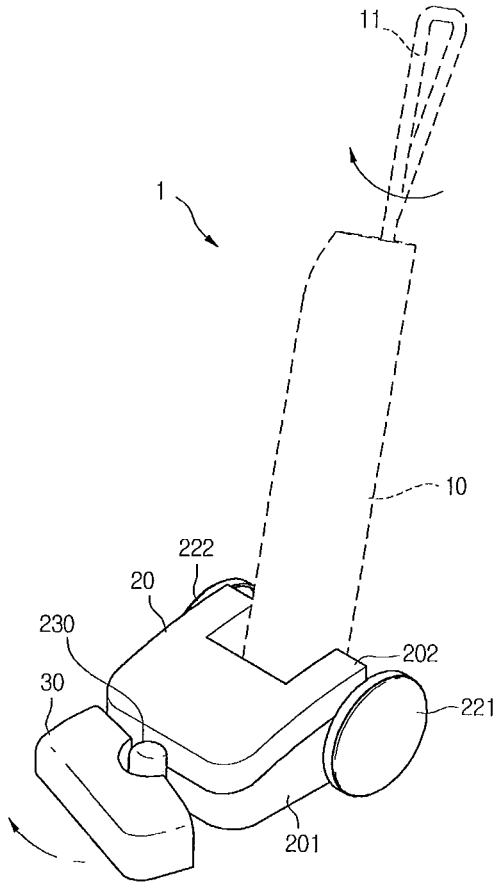
FIG. 7 is a perspective view of the upright vacuum cleaner in a state where the suction nozzle is rotated in a right direction.
Figure 8:
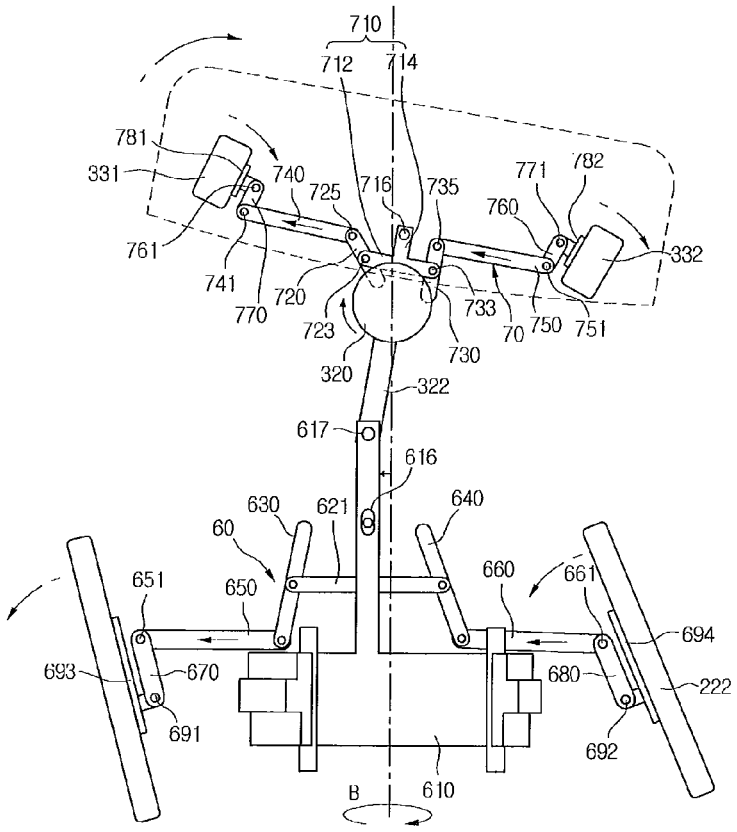
FIG. 8 is a view of the steering device when the suction nozzle is rotated in a right direction.

FIG. 5 is a perspective view of the upright vacuum cleaner in a state where the suction nozzle is rotated in a left direction. FIG. 6 is a view of the steering device when the suction nozzle is rotated in a left direction. FIG. 7 is a perspective view of the upright vacuum cleaner in a state where the suction nozzle is rotated in a right direction. FIG. 8 is a view of the steering device when the suction nozzle is rotated in a right direction.

Referring to FIGS. 1 to 6, to rotate the suction nozzle in a left direction, the user rotates the handle 11 in a left direction in a state where the user grasps the handle 11. That is, the user rotates a wrist of his hand grasping the handle 11 in a counter clockwise direction.

In the current embodiment, the moving direction of each of the links constituting the steering device is defined with respect to FIG. 6.

Thus, the main body 10 and the first transmission part 610 are rotated in an A direction of FIG. 6. When the first transmission part 610 is rotated in the A direction, the extension part 615 of the first transmission part 610 is rotated with a right direction component in FIG. 6. Thus, the shaft 617 is moved together with the extension part 615 in a right direction.

Since the shaft 617 is connected to the connector 322 of the head 30, the head 30 is rotated together with the connector 322 in a counter clockwise direction.

In detail, when the first transmission part 610 is rotated in the A direction, the first link 620 is rotated in a right direction. The first link 620 pushes the second right link 640 in a right direction and pulls the second left link 630. Thus, each of the third links 650 and 660 are moved in the right direction.

When the third right link 660 is moved in the right direction, the fourth right link 680 is rotated in a clockwise direction with respect to the right shaft 692. Thus, the right main wheel 222 is rotated by an angle of about θ2 in a clockwise direction together with the second wheel body 694.

Also, when the third left link 650 is moved in a right direction, the third left link 650 pulls the fourth left link 670. Thus, the fourth left link 670 is rotated in the clockwise direction with respect to the left shaft 691. Thus, the left main wheel 221 is rotated by an angle of about θ1 in a clockwise direction together with the first wheel body 693.

When the head 30 is rotated in a counter clockwise direction, the fixed shaft 716 and the first link 710 are rotated together with the head 30. When the first link 710 is rotated in the counter clockwise direction, the second right link 730 pushes the third right link 750, and the second left link 720 pulls the third left link 740 in a right direction.

When the third right link 750 is moved in the right direction, the fourth right link 770 is rotated in a counter clockwise direction with respect to the right shaft 771. Thus, the left sub wheel 332 is rotated by an angle of about θ4 in a counter clockwise direction together with the second wheel body 782.

Also, when the third left link 740 is moved in a right direction, the third left link 740 pulls the fourth left link 760. Thus, the fourth left link 760 is rotated in the counter clockwise direction with respect to the left shaft 761. Thus, the left sub wheel 331 is rotated by an angle of about θ3 in a clockwise direction together with the first wheel body 781.

In the current embodiment, to rotate the suction nozzle in the left direction, the plurality of sub wheels 331 and 332 are rotated in the counter clockwise direction and the plurality of main wheels 221 and 222 are rotated in the clockwise direction. That is, the plurality of main wheels 221 and 222 are rotated in a direction opposite to that of the plurality of sub wheels 331 and 332. This is for smoothly changing the rotation direction of the suction nozzle.

In the current embodiment, the angle θ1 is greater than the angle θ2, and the angle θ3 is greater than the angle θ4. This reason will be described below. When the suction nozzle is rotated in a left direction, a distance from a virtual rotation center of the suction nozzle to the left main wheel 221 is less than that from the virtual rotation center to the right main wheel 222.

Also, a distance from the virtual rotation center of the suction nozzle to the left sub wheel 331 is less than that form the virtual rotation center to the right sub wheel 332.

Thus, to smoothly rotate the suction nozzle in the left direction, the left main wheel 221 should have a rotation angle greater than that of the right main wheel 222. Also, the left sub wheel 331 should have a rotation angle greater than that of the right sub wheel 332.

That is, a reason in which the angle between the sub wheels and the angle between the main wheels are different from each other is because a steering angle between the sub wheels and the a steering angle between the main wheels are different from each other due to a principle of an Ackerman's angle (Ackerman-jantoud type).

In the current embodiment, the steering device uses a principle of a trapezoid steering mechanism.

Referring to FIGS. 7 and 8, to rotating the suction nozzle in a right direction, the user rotates the handle 11 in a right direction in a state where the user grasps the handle 11. That is, the user rotates the wrist of his hand grasping the handle 11 in a clockwise direction.

Thus, the main body 10 and the first transmission part 610 are rotated in a B direction of FIG. 8. When the first transmission part 610 is rotated in the B direction, the extension part 615 of the first transmission part 610 is rotated with a left direction component in FIG. 8. Thus, the shaft 617 is moved together with the extension part 615 in a left direction.

An operation of the steering device when the suction nozzle is rotated in the right direction will be omitted because the steering device when the suction nozzle is rotated in the right direction is operated in a direction opposite to that of the steering device when the suction nozzle is rotated in the left direction. As described above, to change the rotation direction of the suction nozzle, a force applied to the main body 10 is transmitted into a front wheel and a rear wheel by the steering devices 60 and 70. Thus, since each of the wheels is rotated in a desired direction by the steering device, the user may easily change the rotation direction of the suction nozzle even though the user applies a less force.

In the current embodiment, the front wheel and the rear wheel are steered using the two steering devices. On the other hand, the front wheel or the rear wheel may be steered using a single steering device. In this case, the suction nozzle may be easily changed in direction when compared that a steering device according to a related art is not provided.

Figure 9:
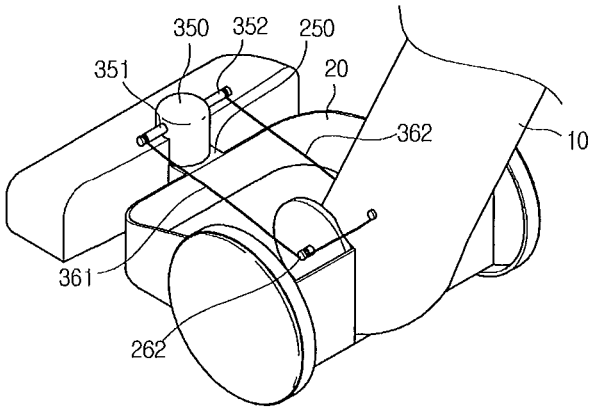
FIG. 9 is a partial perspective view of an upright vacuum cleaner having a structure for transmitting a rotation power of a main body into a head according to a second embodiment.
Figure 10:
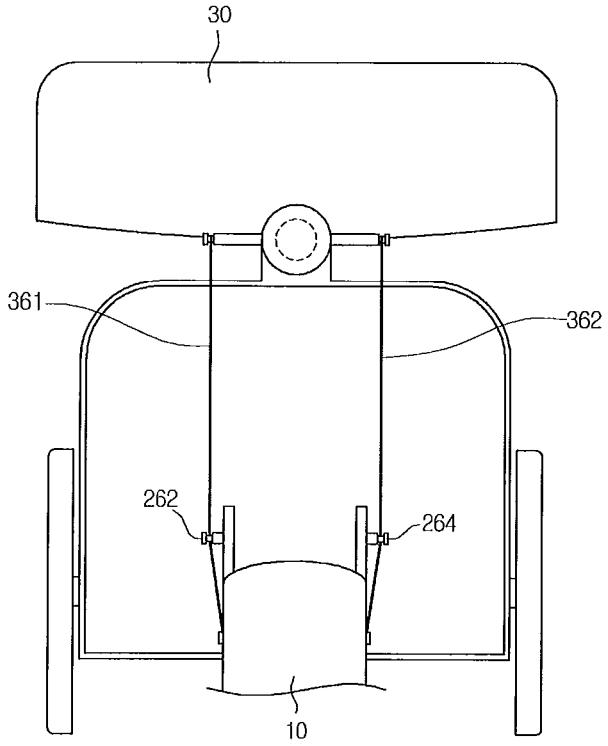
FIG. 10 is a plan view of the upright vacuum cleaner according to the second embodiment.

FIG. 9 is a partial perspective view of an upright vacuum cleaner having a structure for transmitting a rotation power of a main body into a head according to a second embodiment. FIG. 10 is a plan view of the upright vacuum cleaner according to the second embodiment.

The current embodiment is the same as the first embodiment except for a structure for transmitting a rotation force of a main body into a head and a steering of a front wheel. Thus, only specific portions of the current embodiment will be described below.

Referring to FIGS. 9 and 10, a vacuum cleaner according to the current embodiment includes a steering device only on a head 30. That is, the steering device having the same structure as that of the second steering device 70 according to the first embodiment is disposed on the head 30 according to the current embodiment. Thus, the structure of the steering device according to the current embodiment will be cited by that of the first embodiment, and thus, its detailed description will be omitted.

A rotation guide 350 for rotatably coupling the head 30 to a connection device 20 is disposed on the head 30. Also, a guide coupling part 250 is disposed on the connection device 20 to couple the connection device 20 to the rotation guide 350.

A pair of transmission parts 361 and 362 for transmitting a rotation force of the main body 10 into the head 30 is connected to the main body 10. The pair of transmission parts 361 and 362 includes a first transmission part 361 and a second transmission part 362. For example, the pair of transmission parts 361 and 362 may be a wire.

A pair of connection parts 351 and 352 to which the transmission parts 361 and 362 are respectively connected is disposed on the rotation guide 350. The pair of connection parts 351 and 352 includes a first connection part 351 and a second connection part 352.

The first connection part 361 has one end fixed to the first connection part 351 and the other end fixed to one side of the main body 10. The second connection part 362 has one end fixed to the second connection part 352 and the other end fixed to the other side of the main body 10.

The connection device 20 includes a pair of pulleys 262 and 264 to maintain a tension of each of the transmission parts 361 and 362. The pair of pulleys 262 and 264 includes a first pulley 262 for maintaining the tension of the first transmission part 361 and a second pulley 264 for maintaining the tension of the second transmission part 362.

Figure 11:
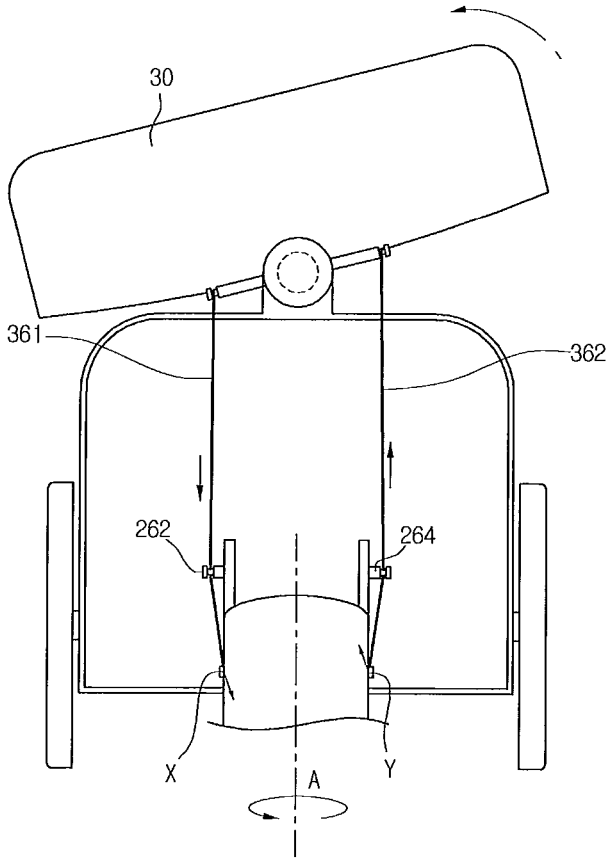
FIG. 11 is a view of a state in which a suction nozzle is rotated in a left direction.
Figure 12:
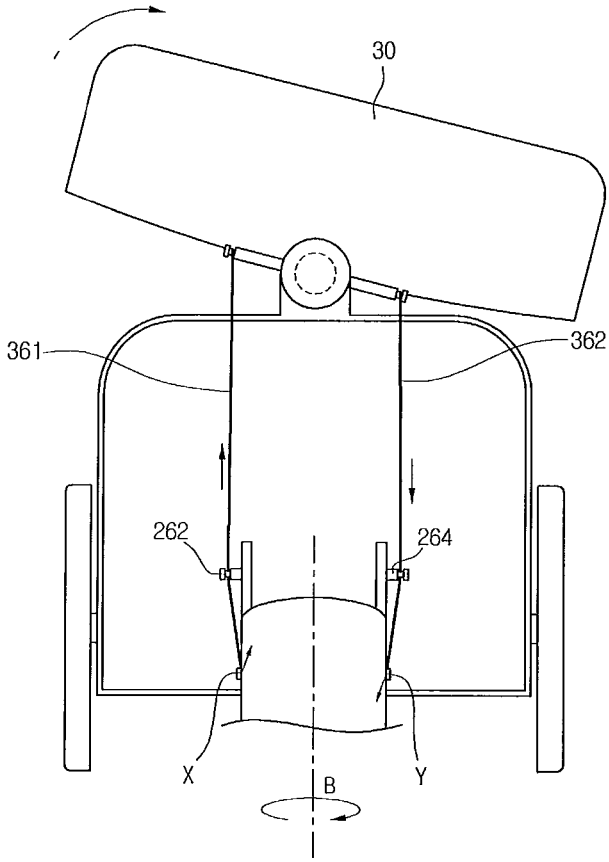
FIG. 12 is a view of a state in which the suction nozzle is rotated in a right direction.

Hereinafter, an operation of the cleaner according to the current embodiment will be described. FIG. 11 is a view of a state in which a suction nozzle is rotated in a left direction. FIG. 12 is a view of a state in which the suction nozzle is rotated in a right direction.

Referring to FIGS. 9 to 11, to rotate the suction nozzle in a left direction, a user rotates the handle in a left direction in a state where the user grasps the handle. That is, the user rotates the wrist of his hand grasping the handle in a counter clockwise direction (an A direction of FIG. 11).

Thus, the first pulley 262 is away from a position X at which the first transmission part 361 is fixed to the main body. On the other hand, the second pulley 264 may approach a position Y at which the second transmission part 362 is fixed to the main body. Thus, the main body 10 pulls the first transmission part 361 and the head 30 is rotated in a counter clockwise direction. Thus, the steering device within the head may be operated in the same state as that of FIG. 6.

On the other hand, referring to FIG. 12, to rotate the suction nozzle in a right direction, the user rotates the handle in a right direction in a state where the user grasps the handle. That is, the user rotates the wrist of his hand grasping the handle in a clockwise direction (a B direction of FIG. 12).

Thus, the second pulley 264 may be away from the position Y at which the second transmission part 362 is fixed to the main body. On the other hand, the first pulley 262 may approach the position X at which the first transmission part 361 is fixed to the main body. Thus, the main body 10 pulls the second transmission part 362 and the head 30 is rotated in the clockwise direction. Thus, the steering device within the head may be operated in the same state as that of FIG. 8.

Figure 13:
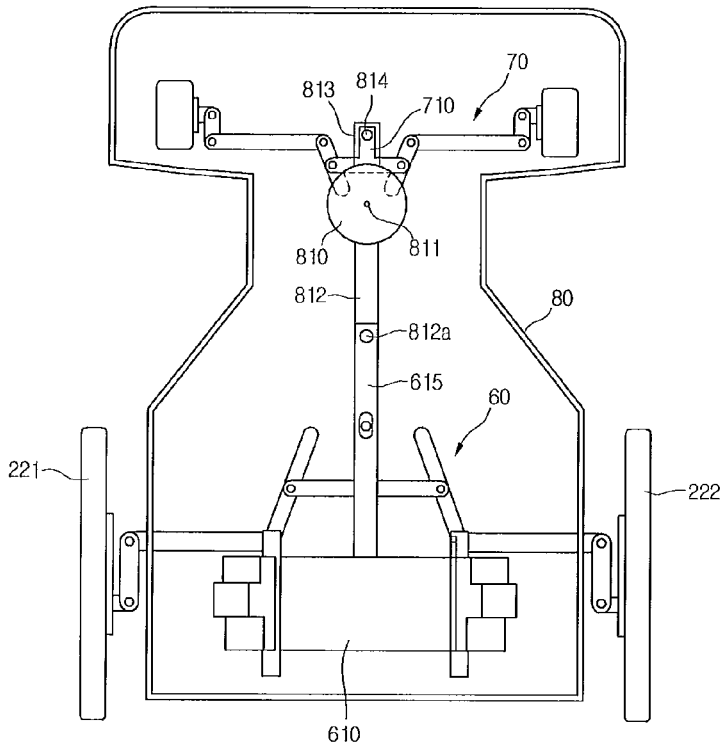
FIG. 13 is a view illustrating a structure of a steering device of a suction nozzle according to a third embodiment.

FIG. 13 is a view illustrating a structure of a steering device of a suction nozzle according to a third embodiment. The current embodiment is the same as the first embodiment except for an integrated structure of a head and connection device and a structure for transmitting a power into a second steering device. Thus, only specific portions of the current embodiment will be described below.

Referring to FIG. 13, a suction nozzle 80 according to the current embodiment includes a first steering device 60 and a second steering device. Each of the steering devices 60 and 70 has the same structure as that of each of the steering devices 60 and 70 according to the first embodiment. Thus, the steering devices 60 and 70 according to the current embodiment will be cited by those of the first embodiment.

The suction nozzle includes a second transmission part 810 for transmitting a power of the first steering device 60 into the second steering device 70. The second transmission part 810 is rotatably connected to a suction nozzle 80 by a rotation shaft 811.

The second transmission part 810 includes a first extension part 812 extending toward the first steering device 60 and a second extension part 813 extending in a direction opposite to that of the first extension part 812.

The first extension part 812 is rotatably connected to an extension part 615 extending from a first transmission part 610 by a shaft 812*a*. The second extension part 813 is rotatably connected to a first link 710 of a second steering device 70 by a shaft 814.

According to the current embodiment, the rotation force of the main body is transmitted into the first steering device through the first transmission part to steer a rear wheel. Also, the second steering device is operated by the transmission part receiving the rotation force of the main body from the main body to steer a front wheel.

The invention claimed is:

1. An upright vacuum cleaner comprising:
a main body;
a suction nozzle relatively rotatable with respect to the main body, the suction nozzle comprising:
a head provided with a plurality of front wheels; and
a connection device that connects the head to the main body and provided with a plurality of rear wheels; and
a steering device configured to steer the plurality of front and rear wheels to correspond to the movement of the main body.

2. The upright vacuum cleaner according to claim 1, wherein the steering device rotates each of the front and rear wheels at rotation angles different from each other.

3. The upright vacuum cleaner according to claim 1, wherein the steering device comprises:
a first steering device for steering the plurality of rear wheels; and
a second steering device for steering the plurality of front wheels.

4. The upright vacuum cleaner according to claim 3, wherein, when the plurality of front wheels are rotated in one direction, the plurality of rear wheels are rotated in the other direction.

5. The upright vacuum cleaner according to claim 3, wherein the first steering device comprises:
a first transmission part for transmitting the rotation force of the main body into the head; and
a second transmission part for transmitting the rotation force of the first transmission part into the plurality of rear wheels.

6. The upright vacuum cleaner according to claim 3, wherein the head receives the rotation force of the main body from the first steering device, and
wherein the second steering device transmits the rotation force transmitted from the head into the plurality of front wheels.

7. The upright vacuum cleaner according to claim 3, wherein the suction nozzle comprises a transmission part for transmitting the rotation force of the first steering device into the second steering device.

8. The upright vacuum cleaner according to claim 1, wherein the steering device comprises:
a first link movable when the main body is rotated;
a pair of second links rotatably connected to the first link;
a pair of third links rotatably connected to the pair of second links, respectively; and
a pair of fourth links rotatably respectively connected to the pair of third links, the pair of fourth links transmitting a power into each of the wheels.

9. The upright vacuum cleaner according to claim 8, wherein the pair of second links is connected to both sides of the first link, respectively.

10. The upright vacuum cleaner according to claim 8, wherein the first link is connected to a central portion of each of the second links.

11. The upright vacuum cleaner according to claim 1, wherein the connection device is relatively movably connected to the head.

12. An upright vacuum cleaner comprising:
a main body;
a suction nozzle relatively rotatable with respect to the main body, the suction nozzle comprising a head provided with a plurality of front wheels;
a connection device connecting the head to the main body and provided with a plurality of rear wheels;
a steering device steering the plurality of front wheels to correspond to the movement of the main body; and
a transmission part for transmitting the rotation force of the main body into the head.

13. The upright vacuum cleaner according to claim 12, wherein the transmission part comprises:
a first transmission part connected to one side of the main body and one side of the head; and
a second transmission part connected to the other side of the main body and the other side of the head,
wherein the first or second transmission part pulls the head to rotate the head according to a rotation direction of the main body.

* * * * *